US009427645B1

(12) United States Patent
Salscheider

(10) Patent No.: US 9,427,645 B1
(45) Date of Patent: Aug. 30, 2016

(54) HOCKEY GOAL TRAINER

(71) Applicant: Timothy James Salscheider, Inver Grove Heights, MN (US)

(72) Inventor: Timothy James Salscheider, Inver Grove Heights, MN (US)

(73) Assignee: Timothy James Salscheider, Inver Grove Heights, MN (US)

( * ) Notice: Subject to any disclaimer, the term of this patent is extended or adjusted under 35 U.S.C. 154(b) by 0 days.

(21) Appl. No.: 14/816,551

(22) Filed: Aug. 3, 2015

(51) Int. Cl.
*A63B 69/00* (2006.01)

(52) U.S. Cl.
CPC .... *A63B 69/0026* (2013.01); *A63B 2208/0204* (2013.01)

(58) Field of Classification Search
CPC .. A63B 63/004; A63B 63/00; A63B 69/002; A63B 69/0026; A63B 63/003; A63B 2024/0046; A63B 2024/005
USPC ..... 273/398–402; 473/446, 476–478
See application file for complete search history.

(56) References Cited

U.S. PATENT DOCUMENTS 3,840,228 A * 10/1974 Greaney ..... A63B 63/00 273/127 B
3,856,298 A * 12/1974 Frantti ..... A63B 63/00 273/127 R
3,887,181 A * 6/1975 Samaras ..... A63B 63/00 273/127 B
3,944,223 A * 3/1976 Bromwell ..... A63B 63/00 273/126 R
4,245,843 A 1/1981 Griggs
4,489,940 A * 12/1984 Amundson ..... A63B 69/34 473/435
4,921,257 A * 5/1990 Heller ..... A63B 63/00 473/446
D309,486 S * 7/1990 Guenette ..... D21/699
5,238,243 A * 8/1993 Grispi ..... A63B 63/00 273/389
5,246,229 A * 9/1993 Carey ..... A63B 63/004 473/432
5,503,402 A * 4/1996 Moss, Jr. ..... A63B 63/004 273/400
5,509,650 A * 4/1996 MacDonald ..... A63B 24/0021 273/127 A
5,582,404 A * 12/1996 Parzino ..... A63B 69/34 473/446
5,634,640 A * 6/1997 McCarrel ..... A63B 63/00 273/127 B
D387,110 S * 12/1997 Thiel ..... D21/699
D387,111 S * 12/1997 Delegarde ..... D21/699
5,772,538 A * 6/1998 Sztykiel ..... A63B 63/00 473/446
5,888,153 A * 3/1999 Masin ..... A63B 63/00 273/392
5,928,093 A * 7/1999 Lai ..... A63B 69/34 473/430
D413,949 S * 9/1999 Oudemool ..... D21/705
6,012,994 A * 1/2000 Beluse ..... A63B 69/0026 473/446

(Continued)

*Primary Examiner* — Mark Graham
(74) *Attorney, Agent, or Firm* — Patterson Thuente Pedersen, P.A.

(57) ABSTRACT

A hockey field goal training apparatus for partially blocking the opening of a hockey field goal. The hockey field goal training apparatus including a frame and a frame cover, the frame includes a pair of spaced apart and vertically oriented lateral leg members, wherein each lateral leg member has a top end, a bottom end and a plurality of curves there between, a horizontally oriented top member connectable to the top ends of the pair of lateral leg members via a first set of couplings, wherein the top member has a pair of hockey field goal engaging hooks, and a horizontally oriented bottom member connectable to the bottom ends of the pair of lateral leg members via a second set of couplings, the frame includes a pocket in which the frame is assembled, the frame cover constructed of a material in which a conventional hockey puck cannot penetrate.

20 Claims, 6 Drawing Sheets

(56) References Cited

U.S. PATENT DOCUMENTS 6,264,572 B1 * 7/2001 Matheson ..... A63B 69/0026 273/402
6,695,724 B2 2/2004 Birss
6,899,645 B1 * 5/2005 Hsiao ..... A63B 63/004 273/400
7,134,976 B1 * 11/2006 Smith ..... A63B 24/0021 273/400
8,052,545 B1 * 11/2011 Assenheimer, III . A63B 63/003 473/422
8,187,123 B2 * 5/2012 Pettys ..... A63B 63/00 273/402
8,246,494 B2 * 8/2012 Stephenson ..... A63B 63/004 473/422
9,028,346 B2 * 5/2015 Melin ..... A63B 63/003 273/402
9,120,000 B2 * 9/2015 Weston ..... A63B 63/004
2003/0228941 A1 * 12/2003 Bains ..... A63B 63/004 473/446
2004/0259667 A1 * 12/2004 Berdugo ..... A63B 63/004 473/446
2005/0049089 A1 * 3/2005 Pakieser ..... A63B 69/002 473/446
2007/0265115 A1 * 11/2007 Farquhar ..... A63B 63/004 473/446
2008/0076606 A1 * 3/2008 Siefker ..... A63B 63/004 473/446
2009/0036238 A1 * 2/2009 Sheehan ..... A63B 63/003 473/446
2009/0181810 A1 * 7/2009 Stephenson ..... A63B 63/004 473/446
2013/0023362 A1 * 1/2013 Siefker ..... A63B 63/004 473/446
2013/0184103 A1 * 7/2013 Littman ..... A63B 69/0097 473/435
2014/0045628 A1 * 2/2014 Krohl ..... A63B 63/00 473/446
2014/0087894 A1 * 3/2014 Siefker ..... A63B 63/004 473/446
2015/0196819 A1 * 7/2015 Markham ..... A63B 71/0622 473/446
2015/0283441 A1 * 10/2015 Siefker ..... A63B 63/004 473/446
2016/0016060 A1 * 1/2016 Goldwitz ..... A63B 69/00 473/446

* cited by examiner

HOCKEY GOAL TRAINER

TECHNICAL FIELD

The present disclosure relates generally to sporting equipment. More particularly, the present disclosure relates to a hockey field goal training apparatus for partially blocking the opening of a hockey field goal.

BACKGROUND

Playing of the sport hockey involves shooting a hockey puck into a hockey field goal to score points. During play, one player, often referred to as a goalie, attempts to block the opening of the hockey field goal to prevent the hockey puck from entering the hockey field goal. Training hockey players to improve their skills frequently involves practice in shooting the hockey puck at the hockey field goal. Practicing alone, or without a goalie present, is often consider less than optimal, as a hockey field goal is rarely unguarded in actual play.

Over the years, a number of devices have been created to partially block the opening of a field goal. For example, U.S. Pat. No. 6,695,724 incorporated by reference herein, discloses a series of target goal nets that can be positioned within the opening of a hockey field goal for the pose of at least partially blocking the opening of the hockey field goal. The problem, however, is that the series of target goal nets block only a relatively small portion of the opening of the hockey field goal.

This problem is at least partially addressed by U.S. Patent Publ. No. 2014/0087894, incorporated by reference herein, which discloses a net that is configured to partially obscures the opening of a field goal. The problem with the net, however, is that it is cumbersome to install and remove. Moreover, because the net lacks rigidity, generally the net would need to be connected to both the top and sides of the field goal to prevent a fast moving hockey puck from entering a hockey field goal.

Accordingly, what is needed in the industry is an improved hockey field goal training apparatus that can be quickly installed and removed via a single connection to the hockey field goal, yet is readily collapsible to a storage state for easy transportation and storage.

SUMMARY OF THE DISCLOSURE

Embodiments of the present disclosure meet the need of the industry for a hockey field goal training apparatus for partially blocking the opening of a hockey field goal that can be quickly installed and removed via a simple connection to the top of a conventional hockey field goal. The hockey field goal training apparatus includes a frame to provide the rigidity necessary to stop a fast moving hockey puck from entering a hockey field goal, while being readily disassembled into a storage state for easy transportation.

One embodiment of the present disclosure provides a hockey field goal training apparatus for at least partially blocking the opening of a hockey field goal. The hockey field goal training apparatus includes a frame and a frame cover. In one embodiment, the frame includes a pair of spaced apart and vertically oriented lateral leg members, a horizontally oriented top member, and a horizontally oriented bottom member. Each lateral leg member can have a top end, a bottom end and a plurality of curves there between. The horizontally oriented top member can be connectable to the top ends of the pair of lateral leg members via a first set of couplings. In one embodiment, the member has a pair of hockey field goal engaging hooks so that the hockey field goal training apparatus can be coupled to the top of the hockey field goal. The horizontally oriented bottom member can be connectable to the bottom ends of the pair of lateral leg members via a second set of couplings. The frame cover can include a pocket in which the frame is assembled. In one embodiment, the frame cover is constructed of a material in which a conventional hockey puck cannot penetrate.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
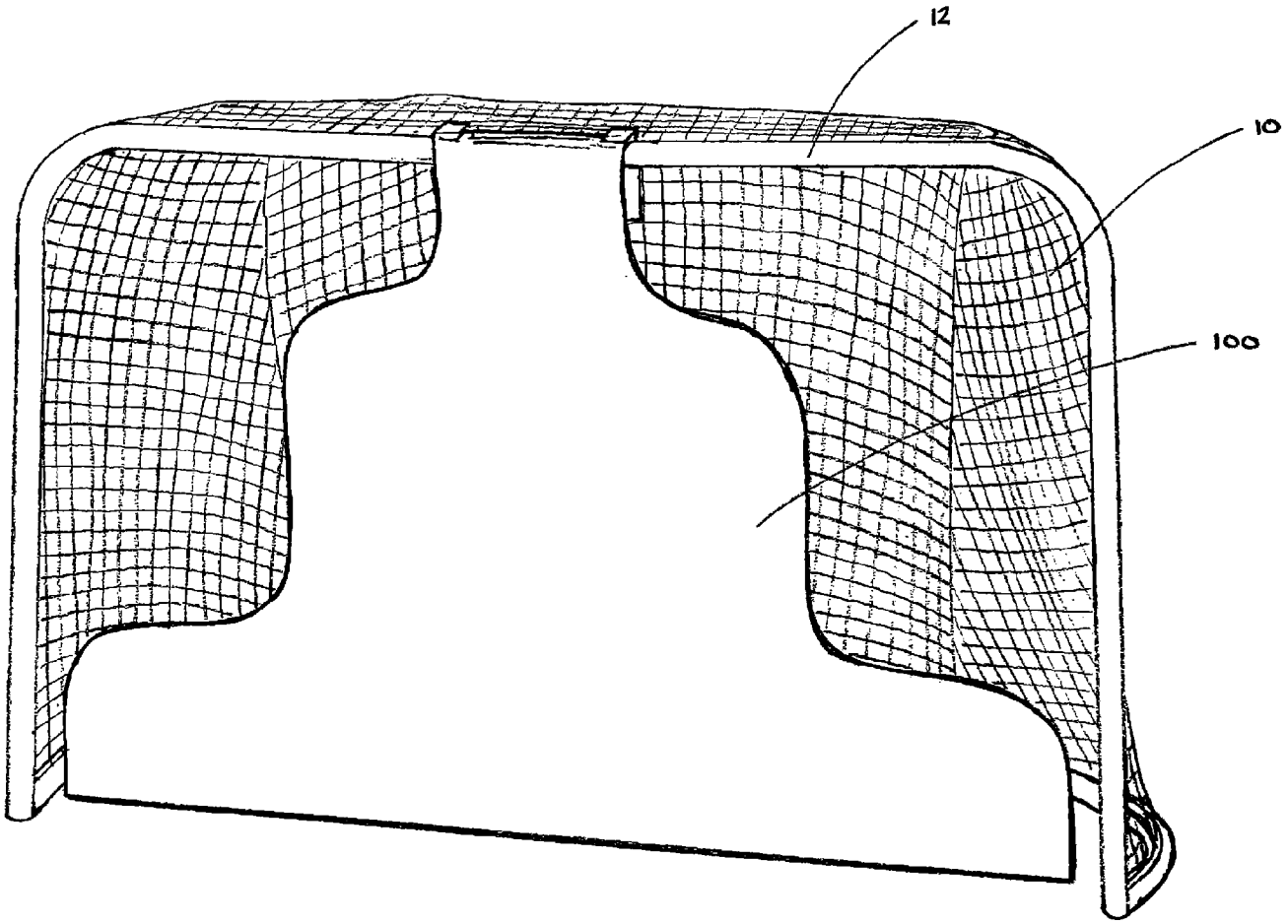
FIG. 1 is a perspective view depicting a hockey field goal training apparatus mounted to a conventional hockey field goal in accordance with an embodiment of the disclosure.

While embodiments of the disclosure are amenable to various modifications and alternative forms, specifics thereof are shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure as defined by the appended claims.

DETAILED DESCRIPTION

Referring to FIG. 1, a hockey field goal training apparatus 100 mounted to a conventional hockey field goal 10 according to a disclosed embodiment is depicted. In particular, the hockey field goal training apparatus 100 is mounted to the top of the frame 12 of the hockey field goal 10. As discussed in detail below, in one embodiment, the hockey field goal training apparatus 100 includes a frame cover that fits over a frame that hangs on hockey field goal 10.

Figure 2A:
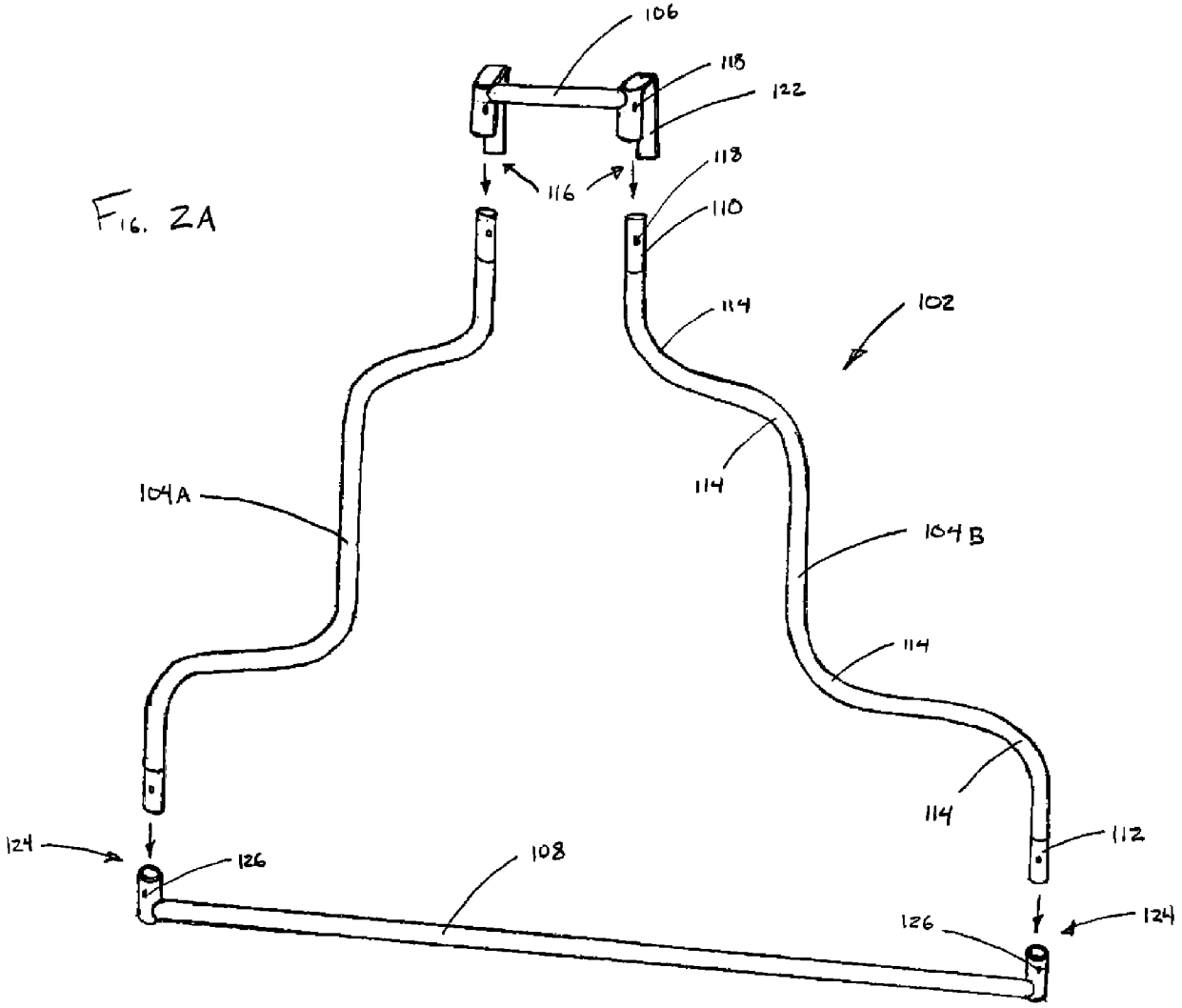
FIG. 2A is a perspective view depicting the disassembled frame of a hockey field goal training apparatus comprising four pieces in accordance with an embodiment of the disclosure.

Referring to FIG. 2A, a disassemble frame 102 of hockey field goal training apparatus 100 10 according to a disclosed embodiment is depicted. In one embodiment, frame 102 is comprised of four pieces, including a pair of leg members 104A/B, a top member 106, and a bottom member 108. Each leg member of the pair of leg members 104A/B can include a top end 110 and a bottom end 112, and a one or more curves 114 between the top end 110 and bottom end 112. Leg members 104A/B can be constructed of a substantially rigid material. For example, in one embodiment, leg members 104A/B are constructed of metal tubing. In other embodiments, leg members 104A/B are constructed of plastic, fiberglass, or another substantially rigid material.

Leg members 104A/B can be selectively coupled to top member 106 via a first set of couplings 116. In one embodiment, couplings 116 can be tubular couplings, wherein each coupling comprises two tubes, one tube being defined by a outside diameter and the other tube being defined by a internal diameter, wherein the inside diameter is sized to fit into and mate with the internal diameter, thereby allowing the two tubes to be joined together to complete the coupling. In one embodiment, the couplings 116 can further include one or more apertures 118 sized to accommodate a pin 120 (depicted in FIG. 4) to secure the two tubes of the coupling in place relative to one another.

Figure 4:
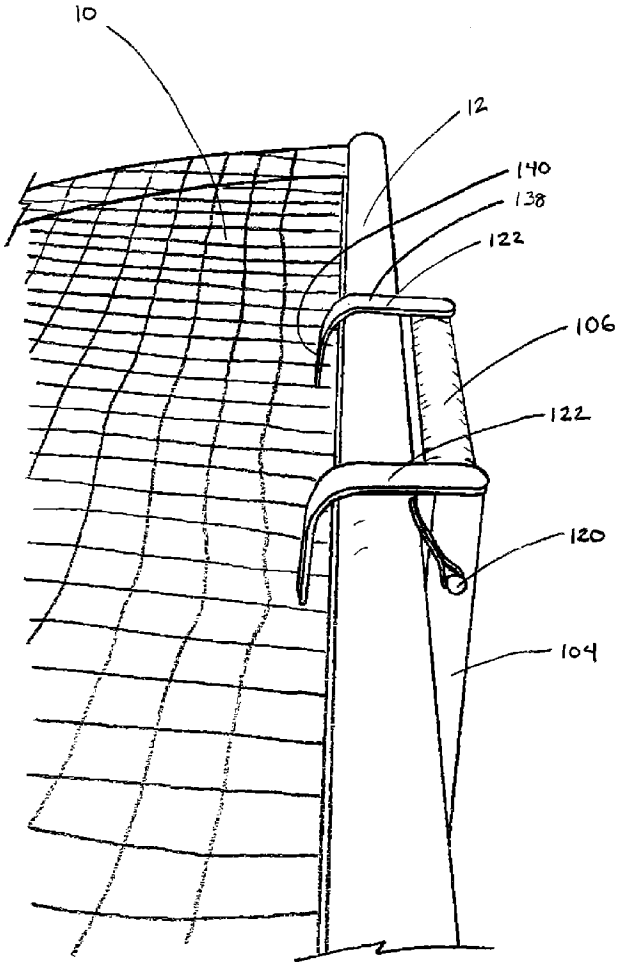
FIG. 4 is a perspective view depicting a hockey field goal training apparatus mounted to a conventional hockey field goal via a pair of hockey field goal engaging hooks in accordance with an embodiment of the disclosure.

Top member 106 can further include a pair of hockey field goal engaging hooks 122 (see also FIG. 4). In one embodiment, hockey field goal engaging hooks 122 are L-shaped metal bars having at least one portion that is configured to slide over a portion of the frame 12 of hockey field goal 10. In other embodiments, the hockey field goal engaging hooks 122 are clamps, straps, or another type of connector.

Leg members 104A/B can be selectively coupled to bottom member 108 via a second set of couplings 124. In one embodiment, couplings 124 can be tubular couplings, like the tubular couplings described above. In one embodiment, the couplings 124 can further include one or more apertures 126 sized to accommodate a pin 120 to secure the leg members 104A/B and bottom member 108 in a fixed position relative to one another.

Figure 2B:
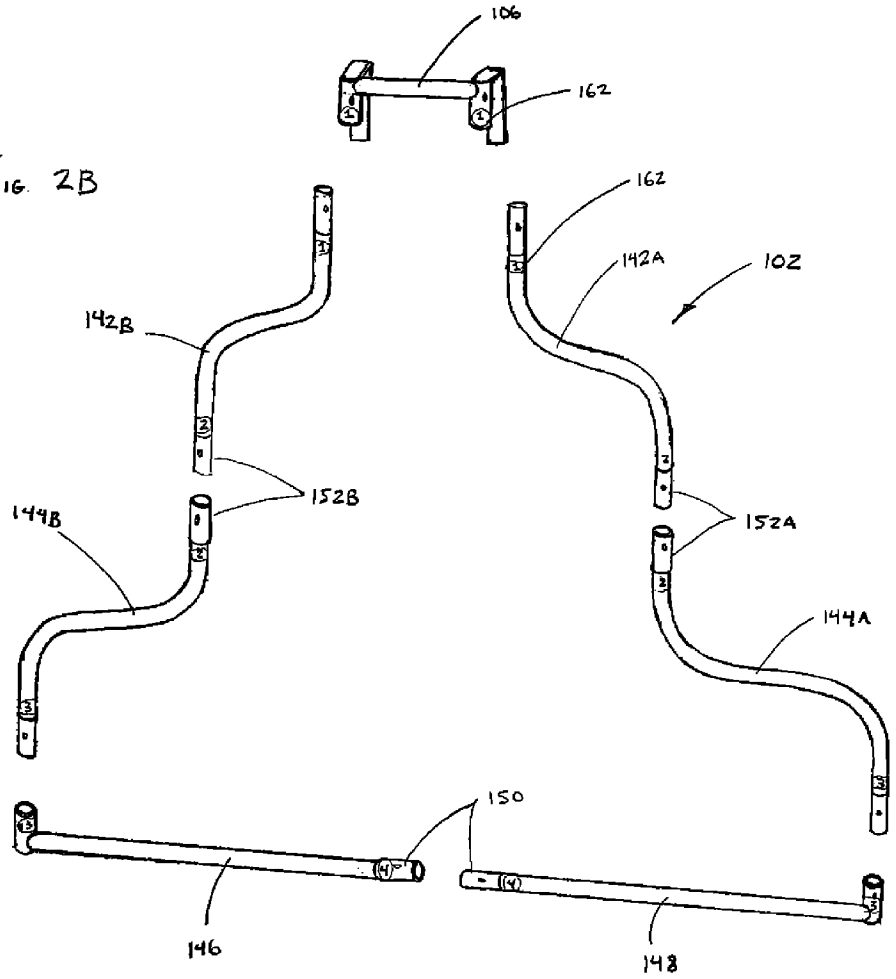
FIG. 2B is a perspective view depicting the disassembled frame of a hockey field goal training apparatus comprising seven pieces in accordance with an embodiment of the disclosure.

Referring to FIG. 2B, a disassemble frame 102 of hockey field goal training apparatus 100 10 comprised of seven pieces according to a disclosed embodiment is depicted. In one embodiment, frame 102 is comprised of seven pieces, including, a top member 106, a bottom member 108 comprised of two pieces 146 and 148, and a pair of leg members 104A/B comprised of a top portion 142A/B and a bottom portion 144A/B. In one embodiment, bottom member pieces 146 and 148 can be coupled together to form completed bottom member 108 via a coupling 150. In one embodiment, top portion 142A/B and bottom portion 144A/B can be coupled together to form completed leg member 104A/B via a coupling 152A/B. In some embodiments, couplings 150 and 152A/B can be like the tubular couplings described above. In one embodiment, each piece of the frame 102 includes labels 162 to indicate proper assembly.

When assembled, the outline of the frame 102 can approximate or resemble the outline of a goalie. In particular, certain curves 114 of leg members 104A/B can approximate the neck, shoulders, legs, and goalie stick of a goalie. In one embodiment, the bottom member 108 has an overall length greater than that of the top member 106. Frame 102 can be constructed of a substantially rigid material. For example, in one embodiment, frame 102 is constructed primarily of metal tubing. In other embodiments, frame 102 is primarily constructed of plastic, fiberglass, or another substantially rigid material.

Figure 3:
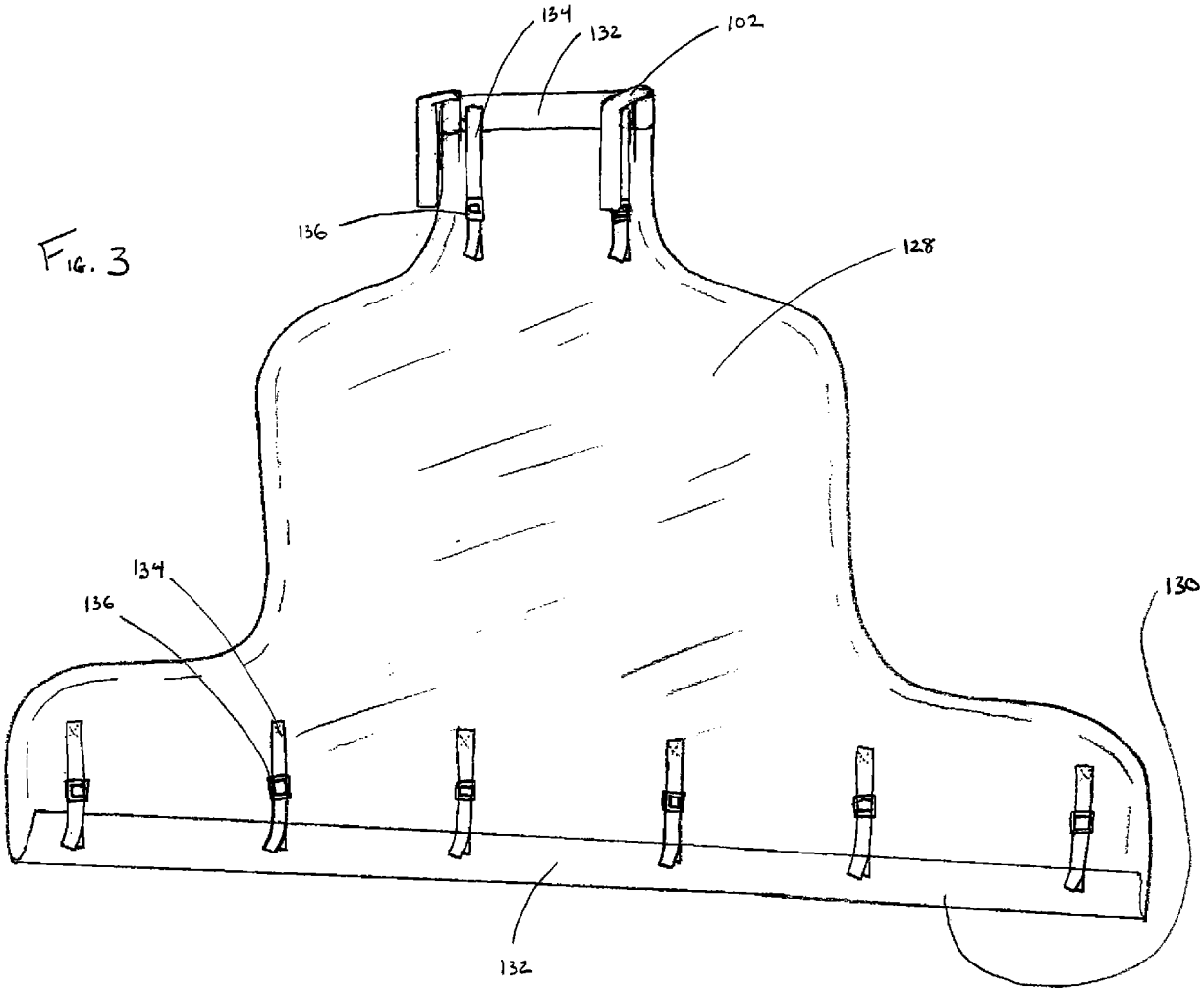
FIG. 3 is a perspective view depicting the frame cover of a hockey field goal training apparatus covering an assembled frame in accordance with an embodiment of the disclosure.

Referring to FIG. 3, a frame cover 128 covering an assembled frame 102 of hockey field goal training apparatus 100 according to a disclosed embodiment is depicted. Frame cover 128 can include one or more pockets 130 in which the assembled frame 102 fits. In one embodiment, a pocket 130 of the frame cover 128 is conformed to fit an outline of the assembled frame 102. In some embodiments the frame cover 128 includes one or more flaps 132 to at least partially close the pocket 130. In some embodiments, the flaps 132 can be secured in a closed position by straps 134. In some embodiments, each strap 134 can include a connectable clip 136 to facilitate easy adjustment of the strap 134 and to enable a more rapid assembly and disassembly of the hockey field goal training apparatus 100.

The frame cover 128 can be constructed of a material in which a conventional hockey puck cannot penetrate. For example, in one embodiment, the frame cover 128 is constructed of a vinyl tarp material. In other embodiments, the frame cover 128 is constructed of canvas, netting, mesh, nylon, polyester, rayon or some other material configured to obscure the opening of hockey field goal 10. In another embodiment, 840 denier nylon is used for frame cover 128. In some embodiments, the material of frame cover 128 can be darkly colored, such as black, grey, or blue, so as to provide a visual contrast between the blocked and unblocked portions of the opening of hockey field goal 10.

Referring to FIG. 4, a hockey field goal training apparatus 100 mounted to a conventional hockey field goal 10 via a pair of hockey field goal engaging hooks 122 according to a disclosed embodiment is depicted. In one embodiment, the pair of hockey field goal engaging hooks 122 comprise a portion of the top member 106. In other embodiments, the pair of hockey field goal engaging hooks 122 are fixedly coupled to either the top member 106 or the leg members 104A/B. The pair of hockey field goal engaging hooks 122 can be curved to conform to a portion of the hockey field goal 10 frame 12. For example, in one embodiment, each hockey field goal engaging hook 122 has a first leg 138 angled relative to a second leg 140 to form an L-shape. In other embodiments, each hockey field goal engaging hook 122 can be in the form of a J-shaped hook, U-shaped hook, or another hook shape. In one embodiment, the pair of hockey field goal engaging hooks 122 are constructed of a rigid material, for example a metal bar.

In operation, the hockey field goal training apparatus 100 can be configured in a disassembled/storage state or in an assembled state. The storage state enables a user to more easily transport and store the hockey field goal training apparatus 100. When assembling the hockey field goal training apparatus 100, a user can unfold the frame cover 128 and open the one or more flaps 132 to ensure that the pocket 130 is open. Top member 106 can be inserted into the pocket 130 through the opening in the top of the pocket 130, or top member 106 can be inserted into the pocket 130 through the opening at the bottom of the pocket 130. The pair leg members 104A/B can be inserted through the opening at the bottom of the pocket 130, and can be connected to the top member 106 while inside the pocket 103 via first set of couplings 116. In some embodiments, one or more pins 120 can be inserted into one or more of apertures 118 on the first set of couplings to secure the top member 106 to the leg members 104A/B. The bottom member 108 can be inserted through the opening at the bottom of the pocket 130, and can be connected to the leg members 104A/B while inside the pocket 103 via second set of couplings 124. In some embodiments, one or more pins 120 can be inserted into one or more of apertures 126 on the second set of couplings 124 to secure the bottom member 108 to the leg members 104A/B.

The assembled hockey field goal training apparatus 100 can be hung on the frame 12 of a conventional hockey field goal 10 via the hockey field goal engaging hooks 122. In one embodiment, the assembled hockey field goal training apparatus 100 is configured to prevent a conventional hockey puck from penetrating the opening of a hockey field goal 10 over an area of the opening commonly occupied by a goalie.

Figure 5:
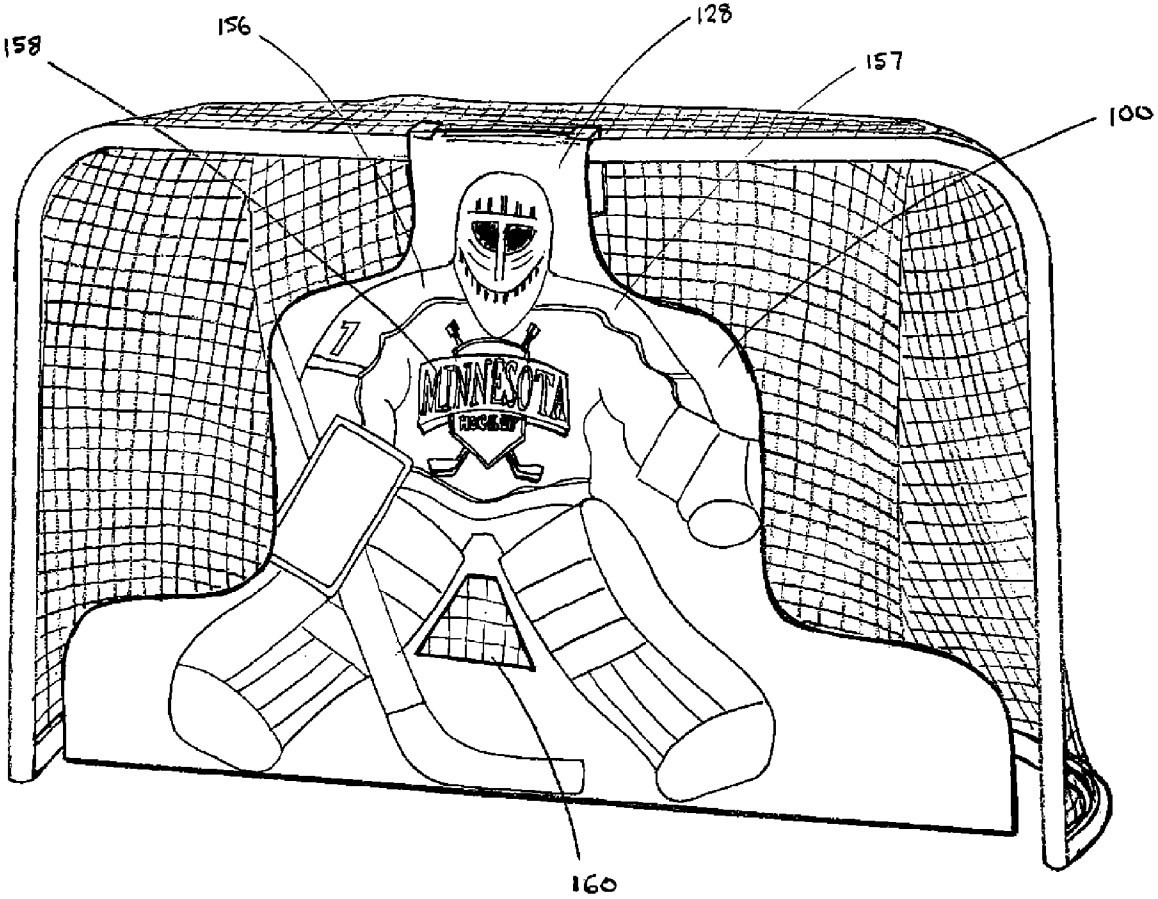
FIG. 5 is a perspective view depicting a hockey field goal training apparatus, wherein the frame cover includes graphics and a cutout in accordance with an embodiment of the disclosure.

Referring to FIG. 5, a hockey field goal training apparatus including a specialized frame cover 128 according to a disclosed embodiment is depicted. In one embodiment, frame cover 128 includes a graphic 156 representing a goalie 157. For example, in one embodiment, the graphic 156 is screen printed on the fabric or material of frame cover 128. The graphic 156 can also be of, or include one or more logos 158, such as a team name or advertising for a brand of sporting equipment or other commercial product or service. In one embodiment, frame cover 128 includes one or more cutouts 160, through which a hockey puck can pass. Each cutout 160 can be configured in a number of shapes and sizes designed to improve puck shooting accuracy.

Persons of ordinary skill in the relevant arts will recognize that embodiments may comprise fewer features than illustrated in any individual embodiment described above. The embodiments described herein are not meant to be an exhaustive presentation of the ways in which the various features may be combined. Accordingly, the embodiments are not mutually exclusive combinations of features; rather, embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A hockey field goal training apparatus for partially blocking the opening of a hockey field goal, comprising:

a frame comprising:

a pair of spaced apart and vertically oriented lateral leg members, wherein each lateral leg member has a top end, a bottom end and a plurality of curves there between;

a horizontally oriented top member connectable to the top ends of the pair of lateral leg members via a first set of couplings, wherein the top member has a pair of hockey field goal engaging hooks; and a horizontally oriented bottom member connectable to the bottom ends of the pair of lateral leg members via a second set of couplings; and a frame cover comprising a pocket in which the frame is assembled, the frame cover constructed of a material in which a conventional hockey puck cannot penetrate.

2. The hockey field goal training apparatus of claim 1, wherein each lateral leg member of the pair of lateral leg members is constructed of a bent metal tube.

3. The hockey field goal training apparatus of claim 2, wherein each lateral leg member of the pair of lateral leg members comprises a series of four curves.

4. The hockey field goal training apparatus of claim 3, wherein the bottom member has an overall length that is longer than the top member.

5. The hockey field goal training apparatus of claim 4, wherein the series of curves approximates the outline of a goalie.

6. The hockey field goal training apparatus of claim 5, wherein the first set of couplings and second set of coupling comprise tube couplings.

7. The hockey field goal training apparatus of claim 6, wherein each coupling of the first and second set of couplings includes a pair of apertures sized to accommodate a pin.

8. The hockey field goal training apparatus of claim 7, wherein each coupling of the first and second set of couplings of the assembled frame is secured by a pin.

9. The hockey field goal training apparatus of claim 1, wherein the frame comprises seven pieces.

10. The hockey field goal training apparatus of claim 1, wherein the pair of hockey field goal engaging hooks are at least partially constructed of a L-shaped metal bars configured to slide over the frame of a hockey field goal.

11. The hockey field goal training apparatus of claim 1, wherein the frame cover is at least partially constructed of a vinyl tarp.

12. The hockey field goal training apparatus of claim 11, wherein the pocket of the frame cover is conformed to fit an outline of the assembled frame.

13. The hockey field goal training apparatus of claim 12, wherein the assembled hockey field goal training apparatus prevents a conventional hockey puck from penetrating the opening of a hockey field goal over an area of the opening commonly occupied by a goalie.

14. The hockey field goal training apparatus of claim 13, wherein the frame cover provides a visual contrast between the blocked and unblocked portions of the hockey field goal opening.

15. The hockey field goal training apparatus of claim 11, wherein the frame cover includes one or more flaps to at least partially close the pocket.

16. The hockey field goal training apparatus of claim 15, wherein the one or more flaps includes a plurality of securing straps.

17. The hockey field goal training apparatus of claim 16, wherein each of the securing straps includes a connectable clip.

18. The hockey field goal training apparatus of claim 17, wherein the frame cover is printed with a graphic, wherein the graphic comprises a goalie, a logo, an advertisement, or a combination thereof.

19. The hockey field goal training apparatus of claim 17, wherein the frame cover includes one or more cutouts.

20. A method of constructing a hockey field goal training apparatus for partially blocking the opening of a hockey field goal, comprising:

providing a frame comprising a pair of spaced apart and vertically oriented lateral leg members, wherein each lateral leg member has a top end, a bottom end and a plurality of curves there between, a horizontally oriented top member connectable to the top ends of the pair of lateral leg members via a first set of couplings, wherein the top member has a pair of hockey field goal engaging hooks, and a horizontally oriented bottom member connectable to the bottom ends of the pair of lateral leg members via a second set of couplings; and providing a frame cover comprising a pocket in which the frame is assembled, the frame cover constructed of a material in which a conventional hockey puck cannot penetrate.

* * * * *